US008938050B2

(12) United States Patent
Lemaitre

(10) Patent No.: US 8,938,050 B2
(45) Date of Patent: Jan. 20, 2015

(54) LOW BIAS MA MODULATION FOR X-RAY TUBES

(75) Inventor: Sergio Lemaitre, Whitefish Bay, WI (US)

(73) Assignee: General Electric Company, Schenectady, NY (US)

( * ) Notice: Subject to any disclaimer, the term of this patent is extended or adjusted under 35 U.S.C. 154(b) by 569 days.

(21) Appl. No.: 12/760,309

(22) Filed: Apr. 14, 2010

(65) Prior Publication Data

US 2011/0255667 A1 Oct. 20, 2011

(51) Int. Cl.

| | |
|---|---|
| ***H01J 35/30*** | (2006.01) |
| ***H01J 35/06*** | (2006.01) |
| ***H05G 1/34*** | (2006.01) |

(52) U.S. Cl.

CPC *H01J 35/06* (2013.01); *H05G 1/34* (2013.01); *H01J 2235/068* (2013.01)

USPC ..... 378/137; 378/113

(58) Field of Classification Search

USPC ..... 378/136, 137–138, 113

See application file for complete search history.

(56) References Cited

U.S. PATENT DOCUMENTS

| | | | | |
|---|---|---|---|---|
| 3,558,964 | A | 1/1971 | White | |
| 3,914,639 | A | 10/1975 | Barraco et al. | |
| 4,607,380 | A | 8/1986 | Oliver | |
| 4,631,742 | A | 12/1986 | Oliver | |
| 4,675,570 | A | 6/1987 | Green | |
| 4,685,118 | A | 8/1987 | Furbee et al. | |
| 4,752,713 | A | 6/1988 | Buxbaum | |
| 4,894,257 | A | 1/1990 | Smith et al. | |
| 5,703,924 | A | 12/1997 | Hell et al. | |
| 5,844,963 | A * | 12/1998 | Koller et al. | 378/136 |
| 6,051,165 | A | 4/2000 | Billings | |
| 6,480,572 | B2 * | 11/2002 | Harris et al. | 378/136 |
| 6,642,657 | B2 | 11/2003 | Mako et al. | |
| 6,759,799 | B2 | 7/2004 | Ricaud | |
| 6,762,540 | B2 | 7/2004 | Schaefer et al. | |
| 6,785,359 | B2 | 8/2004 | Lemaitre | |
| 6,968,039 | B2 | 11/2005 | Lemaitre et al. | |
| 7,206,379 | B2 | 4/2007 | Lemaitre | |
| 7,280,637 | B1 | 10/2007 | Chen et al. | |
| 7,409,043 | B2 | 8/2008 | Dunham et al. | |
| 7,450,690 | B2 | 11/2008 | Block et al. | |
| 7,539,286 | B1 | 5/2009 | Bandy et al. | |
| 7,558,374 | B2 | 7/2009 | Lemaitre | |
| 7,576,481 | B2 | 8/2009 | Lemaitre | |
| 7,627,087 | B2 | 12/2009 | Zou et al. | |
| 7,693,265 | B2 | 4/2010 | Hauttmann et al. | |
| 7,903,788 | B2 | 3/2011 | Moore et al. | |

(Continued)

FOREIGN PATENT DOCUMENTS

| | | |
|---|---|---|
| JP | 611753436 | 8/1986 |
| WO | 2008129006 | 10/2008 |
| WO | 2010002610 A2 | 7/2010 |

OTHER PUBLICATIONS

U.S. Appl. No. 12/698,851, filed Feb. 2, 2010, Sergio Lemaitre.

*Primary Examiner* — Hoon Song

(74) *Attorney, Agent, or Firm* — Fletcher Yoder, P.C.

(57) ABSTRACT

A segmented thermionic emitter is provided. The segmented thermionic emitter has, among other features, a plurality of segments substantially spanning an entire length of the thermionic emitter and aligned substantially parallel with one another. In one embodiment, the segmented thermionic emitter may allow milli-amp modulation of an X-ray tube at voltages less than approximately 2 kV.

18 Claims, 7 Drawing Sheets

(56) References Cited

U.S. PATENT DOCUMENTS

| | | | | |
|---|---|---|---|---|
| 2001/0052743 | A1 | 12/2001 | Hell et al. | |
| 2003/0025429 | A1 | 2/2003 | Hell et al. | |
| 2005/0179024 | A1 | 8/2005 | Shibata et al. | |
| 2007/0083577 | A1 | 4/2007 | Capaldo et al. | |
| 2007/0232183 | A1 | 10/2007 | Lemaitre | |
| 2008/0043916 | A1 | 2/2008 | Lemaitre | |
| 2008/0095317 | A1 | 4/2008 | Lemaitre | |
| 2009/0129550 | A1* | 5/2009 | Bandy et al. | 378/141 |
| 2009/0260233 | A1 | 10/2009 | Lemaitre | |
| 2009/0323898 | A1 | 12/2009 | Moore | |
| 2010/0195797 | A1 | 8/2010 | Hauttmann | |
| 2010/0278307 | A1* | 11/2010 | Moore et al. | 378/136 |
| 2010/0284519 | A1 | 11/2010 | Moore et al. | |
| 2011/0051898 | A1 | 3/2011 | Moore et al. | |

* cited by examiner

LOW BIAS MA MODULATION FOR X-RAY TUBES

BACKGROUND OF THE INVENTION

The present technique relates generally to X-ray sources. In particular, the present disclosure relates to X-ray tube cathodes, such as those contained in X-ray tubes used in medical X-ray imaging.

In non-invasive imaging systems, X-ray tubes are used in both X-ray systems and computer tomography (CT) systems as a source of X-ray radiation. The radiation is emitted in response to control signals during inspection, examination or imaging sequences. Typically, the X-ray tube includes a cathode and an anode. An emitter within the cathode may emit a stream of electrons in response to heat resulting from an applied electrical current via the thermionic effect. The anode may include a target that is impacted by the stream of electrons. The target may, as a result, produce X-ray radiation and heat.

The radiation spans a subject of interest, such as a human patient, and a portion of the radiation impacts a detector or a photographic plate where the image data is collected. In some X-ray systems the photographic plate is then developed to produce an image which may be used by a radiologist or attending physician for diagnostic purposes. In digital X-ray systems a photo detector produces signals representative of the amount or intensity of radiation impacting discrete pixel regions of a detector surface. The signals may then be processed to generate an image that may be displayed for review. In CT systems a detector array, including a series of detector elements, produces similar signals through various positions as a gantry is displaced around a patient.

During operation of the X-ray tube, the amount and energy of X-rays that are emitted by the X-ray tube may be affected by the voltage applied between the anode and cathode within the X-ray tube. Additionally, an electrical current flowing through a thermionic emitter within the cathode may affect the amount of X-ray radiation produced by an X-ray tube. In a general sense, the applied voltage may affect the X-ray penetration through the subject while the current and exposure time may affect the contrast of a resulting X-ray image.

BRIEF DESCRIPTION OF THE INVENTION

The present technique is generally directed to X-ray tubes having thermionic emitters. More specifically, according to present embodiments, segmentation of a thermionic emitter may allow milli-Amp modulation at relatively low voltages for use with fast switching X-ray techniques.

In accordance with one aspect of the present technique, an imaging system is provided. The imaging system includes, among other features, an X-ray tube configured to generate an X-ray beam at one or more energies, the X-ray tube including a cathode assembly having a segmented thermionic emitter. The segmented thermionic emitter has a plurality of segments substantially spanning a length of the thermionic emitter, wherein the segmented thermionic emitter is configured to emit one or more electron beams in a direction towards an anode to generate the X-ray beam. The imaging system also includes an X-ray detector configured to detect X-rays generated by the X-ray tube and generate a signal based on the detected X-rays. Further, the imaging system includes data acquisition circuitry configured to convert the signal generated by the detector into one or more images of a subject of interest.

In accordance with another aspect of the present technique, a segmented thermionic emitter is provided. The segmented thermionic emitter has, among other features, a plurality of segments substantially spanning an entire length of the thermionic emitter and aligned substantially parallel with one another.

In accordance with a further aspect of the present technique, an X-ray tube is provided. The X-ray tube has a cathode assembly including a segmented thermionic emitter. The segmented thermionic emitter has between two and four segments substantially spanning an entire length of the thermionic emitter and aligned substantially parallel with one another. The X-ray tube also includes an anode, wherein the cathode assembly and the anode are each placed at an electrical potential to create a voltage to extract electrons from a surface of the segmented thermionic emitter. The between two and four segments are configured to emit a plurality of electron beams in a direction from the cathode assembly towards the anode at a focal spot.

BRIEF DESCRIPTION OF THE DRAWINGS

These and other features, aspects, and advantages of the present approaches will become better understood when the following detailed description is read with reference to the accompanying drawings in which like characters represent like parts throughout the drawings, wherein.

DETAILED DESCRIPTION OF THE INVENTION

The present approaches are directed to segmented thermionic emitters within X-ray tube cathodes. The thermionic emitters may be segmented to allow milli-amp (mA) modulation of electron emission during operation. That is, X-ray tubes employing the present approaches may be operated and/or modulated (switched) on a timeframe previously inaccessible at the voltages suitable for (mA) modulation. For example, in some imaging sequences, biasing the voltage between the anode and cathode of the X-ray tube and varying the current flowing through the thermionic emitter may modulate the emission of electrons from the surface of the thermionic emitter. The extent of electrons emitted by the thermionic emitter may correspond to the amount of X-ray radiation emitted by the X-ray tube.

According to the present approaches, the amount of X-ray radiation emitted by the X-ray tube may be modulated at the thermionic emitter using relatively low current and/or low voltages. For example, in conventional configurations, a relatively large bias voltage placed on the thermionic emitter may result in a lower-ampere modulation of the electron beam emitted by the thermionic emitter. However, the higher driving voltages to allow such mA modulation are often above approximately 20 kV (e.g., 80 to 120 kV). Such driving voltages may be unsuitable for use with fast switching technology, which may employ voltages below approximately 2 kV. The present approaches allow modulation at mA currents by segmenting the thermionic emitter. For example, segmentation of the thermionic emitter substantially in the length direction allows operation over a wide range of temperatures, voltages, and/or currents. In some embodiments, the thermionic emitter may be segmented into two segments, three segments, four segments, or five or more segments, depending on the size of the thermionic emitter. In one embodiment, increasing the number of segments of the thermionic emitter may reduce the bias voltage suitable for mA modulation. In some embodiments, the number of segments of the thermionic emitter may be chosen to avoid damage due to heating and/or ion bombardment. For example, other thermionic emitter technologies employing very small segmentation sizes, such as a mesh, may experience problems such as thermo-mechanical degradation.

Figure 1:
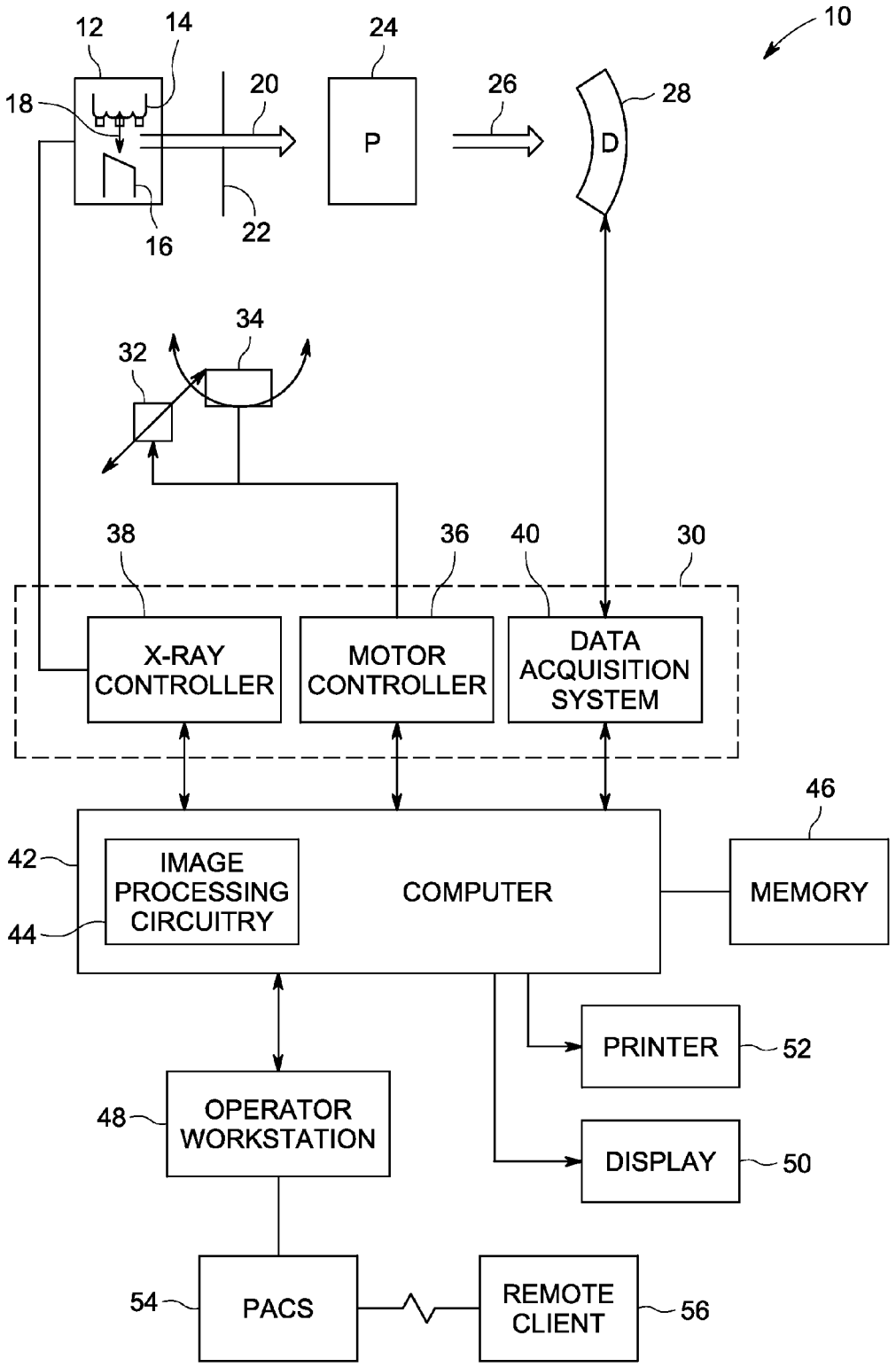
FIG. 1 depicts a diagrammatical representation of a digital X-ray imaging system incorporating an X-ray tube in accordance with aspects of the present disclosure.

With this in mind, and turning now to the figures, FIG. 1 is a diagram that illustrates an imaging system 10 for acquiring and processing image data. In the illustrated embodiment, system 10 is a computed tomography (CT) system designed to acquire X-ray projection data, to reconstruct the projection data into a tomographic image, and to process the image data for display and analysis. Though the imaging system 10 is discussed in the context of medical imaging, the techniques and configurations discussed herein are applicable in other non-invasive imaging contexts, such as baggage or package screening or industrial nondestructive evaluation of manufactured parts. In the embodiment illustrated in FIG. 1, the CT imaging system 10 includes an X-ray source 12. As discussed in detail herein, the source 12 may include one or more X-ray sources, such as an X-ray tube. For example, the source 12 may include an X-ray tube with a cathode assembly 14 and an anode 16 as described in more detail with respect to FIG. 2 below. The cathode assembly 14 accelerates a stream of electrons 18 (i.e., the electron beam) toward a target anode 16. According to present embodiments, the cathode assembly 14 may be configured to allow mA modulation of the stream of electrons 18. The impact of the stream of electrons 18 on the anode 16 causes the emission of an X-ray beam 20. Therefore, the modulation of the stream of electrons 18 may allow a concomitant modulation, such as fast switching (microsecond switching), of the X-ray beam 20.

The source 12 may be positioned proximate to a collimator 22 used to define the size and shape of the one or more X-ray beams 20 that pass into a region in which a subject 24 or object is positioned. Some portion of the X-ray beam is attenuated by the subject 24 and the attenuated X-rays 26 impact a detector array 28 formed by a plurality of detector elements. Each detector element produces an electrical signal that represents the intensity of the X-ray beam incident at the position of the detector element when the beam strikes the detector 28. Electrical signals are acquired and processed to generate one or more scan datasets.

A system controller 30 commands operation of the imaging system 10 to execute examination and/or calibration protocols and to process the acquired data. With respect to the X-ray source 12, the system controller 30 furnishes power, focal spot location, control signals and so forth, for the X-ray examination sequences. The detector 28 is coupled to the system controller 30, which commands acquisition of the signals generated by the detector 28. In addition, the system controller 30, via a motor controller 36, may control operation of a linear positioning subsystem 32 and/or a rotational subsystem 34 used to move components of the imaging system 10 and/or the subject 24. The system controller 30 may include signal processing circuitry and associated memory circuitry. In such embodiments, the memory circuitry may store programs, routines, and/or encoded algorithms executed by the system controller 30 to operate the imaging system 10, including the X-Oray source 12, and to process the data acquired by the detector 28. In one embodiment, the system controller 30 may be implemented as all or part of a processor-based system such as a general purpose or application-specific computer system.

The source 12 may be controlled by an X-ray controller 38 contained within the system controller 30. The X-ray controller 38 may be configured to provide power and timing signals to the source 12. In addition, in some embodiments the X-ray controller 38 may be configured to selectively activate the source 12 such that tubes or emitters at different locations within the system 10 may be operated in synchrony with one another or independent of one another. According to the approaches described herein, the X-ray controller 38 may modulate activation or operation of one, two, three or more segments of the segmented thermionic emitter (described below) contained within the cathode assembly 14. Further, the X-ray controller 38 may provide timing signals, such as current modulations on a microsecond timeframe, to modulate the X-ray source 12. For example, the X-ray controller 38 may be configured to execute code for switching the source 12 in less than approximately 1 millisecond.

The system controller 30 may include a data acquisition system (DAS) 40. The DAS 40 receives data collected by readout electronics of the detector 28, such as sampled analog signals from the detector 28. The DAS 40 may then convert the data to digital signals for subsequent processing by a processor-based system, such as a computer 42. In other embodiments, the detector 28 may convert the sampled analog signals to digital signals prior to transmission to the data acquisition system 40. The computer 42 may include or communicate with one or more suitable memory devices 46 that can store data processed by the computer 42, data to be processed by the computer 42, or routines and/or algorithms to be executed by the computer 42. The computer 42 may be adapted to control features enabled by the system controller 30 (i.e., scanning operations and data acquisition), such as in response to commands and scanning parameters provided by an operator via an operator workstation 48. From the workstation 48, the operator may input various imaging routines, such as routines that may modulate the X-ray source 12 within less than approximately 1 millisecond.

The system 10 may also include a display 50 coupled to the operator workstation 48 that allows the operator to view relevant system data, imaging parameters, raw imaging data, reconstructed data, and so forth. Additionally, the system 10 may include a printer 52 coupled to the operator workstation 48 and configured to print any desired measurement results. The display 50 and the printer 52 may also be connected to the computer 42 directly or via the operator workstation 48. Further, the operator workstation 48 may include or be coupled to a picture archiving and communications system (PACS) 54. PACS 54 may be coupled to a remote system 56, radiology department information system (RIS), hospital information system (HIS) or to an internal or external network, so that others at different locations can gain access to the image data.

Figure 2:
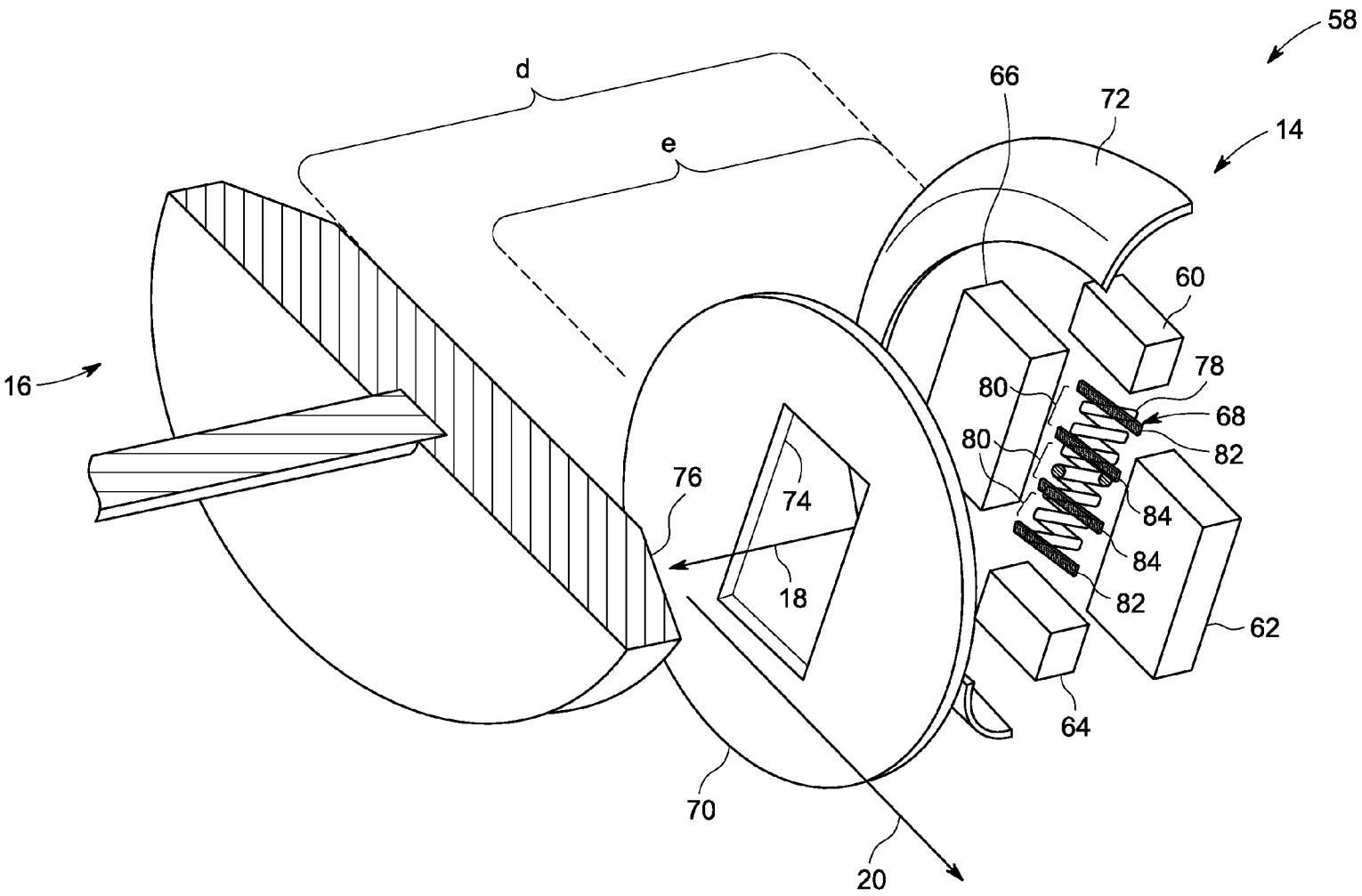
FIG. 2 is an exploded perspective view of an X-ray tube having a segmented thermionic emitter in accordance with one aspect of the present disclosure.

With the foregoing in mind, FIG. 2 is an exploded perspective view of an embodiment of an X-ray tube assembly 58, including embodiments of the cathode assembly 14 and the anode 16 depicted in FIG. 1. In the illustrated embodiment, the cathode assembly 14 and the target anode 16 are placed at a cathode-target distance d away from each other, and are oriented towards each other. The cathode assembly 14 is illustrated as including a set of optional biasing electrodes (i.e., deflection electrodes) 60, 62, 64, 66, which may control the size and/or shape of the stream of electrons 18. According to the present approaches, the cathode assembly 14 includes a segmented thermionic emitter 68, which is configured to allow mA modulation of the stream of electrons 18 at voltages at or below approximately 2 kV. In the illustrated embodiment, the cathode assembly 14 also includes an extraction electrode 70 and a shield 72. The cathode assembly 14 and its respective components are described in more detail with respect to FIG. 3 below. The anode 16 may be manufactured of any suitable metal or composite, including tungsten, molybdenum, or copper. The anode's surface material is typically selected to have a relatively high refractory value so as to withstand the heat generated by electrons impacting the anode 16. In certain embodiments, such as the illustrated embodiment, the anode 16 may be a rotating disk. During operation of the X-ray tube 58, the anode 16 may be rotated at a high speed (e.g., 1,000 to 10,000 revolutions per minute) to spread the thermal energy resulting from the stream of electrons 18 passing through opening 74, and to achieve a higher temperature tolerance. The rotation of the anode 16 results in the temperature of the focal spot 76 (i.e., the location on the anode impinged upon by the electrons) being kept at a lower value than when the anode 16 is not rotated, thus allowing for the use of high flux X-ray embodiments.

The cathode assembly 14, i.e., electron source, is positioned a cathode-target distance d away from the anode 16 so that the stream of electrons 18 generated by the cathode assembly 14 is focused on a focal spot 76 on the anode 16. The space between the cathode assembly 14 and the anode 16 may be evacuated in order to minimize electron collisions with other atoms and to maximize an electric potential. In conventional X-ray tubes, such as those using a non-segmented thermionic emitter, voltages in excess of 20 kV are typically created between the cathode assembly 14 and the anode 16, causing electrons emitted by the thermionic emitter to become attracted to the anode 16. Typically, the flux of electrons emitted by a thermionic emitter may be modulated by the current flowing through the thermionic emitter and/or the voltage between the cathode assembly 14 and the extraction electrode 70.

According to the approaches described herein, a filament 78 has segments 80 that are formed by a series of segmentation electrodes. Such electrodes may include end electrodes 82 and middle electrodes 84, and it should be noted that the filament 78 may be segmented by more or less electrodes, such as approximately one, two, three, four electrodes, or more. Together, these segments 80 may form the segmented thermionic emitter 68. In such embodiments, mA modulation of the stream of electrons 18 produced by the segmented thermionic emitter 68 may be achieved at voltages less than approximately 2 kV. For example, the smaller segments 80 that result from segmentation of the filament 78 may be addressed individually, such that lower magnitude voltages may be used for modulating one, more than one, or all of the segments of the segmented thermionic emitter 68. Accordingly, the total voltage and/or current suitable for modulating the segmented thermionic emitter 68 may be less than if a conventional, non-segmented thermionic emitter were employed. In some embodiments, electrostatic switching of the X-ray tube 58 due to a voltage change is a faster process than switching the X-ray tube 58 using thermal switching, which is the result of a current change. Thus, the X-ray tube 58 may be controllably switched in the microsecond regime, rather than the millisecond timeframe resulting from thermal modulation.

It should be noted that in some embodiments, each segment 80 may emit a stream of electrons. As such, the stream of electrons 18 may include one or more composite electron beams produced by the segments 80. The cathode assembly 14 and its features, including the segmented thermionic emitter 68, are discussed in further detail below. As noted above, the stream of electrons 18 produced by the segmented thermionic emitter 68 is directed toward the anode 16. The resulting electron bombardment of the focal spot 76 will generate the X-ray beam 20 through the Bremsstrahlung effect, i.e., braking radiation. In one embodiment, the distance d is a factor in determining characteristics of the focal spot 76, such as length and width, and accordingly, the imaging capabilities of the generated X-ray beam 20.

In certain embodiments, the extraction electrode 70 is included and is located between the cathode assembly 14 and the anode 16. In other embodiments, the extraction electrode 70 is not included. When included, the extraction electrode may be kept at the anode 16 potential, in some cases, up to approximately 140 kV. As mentioned, the opening 74 allows for the passage of electrons through the extraction electrode 70. In the depicted embodiment, the extraction electrode 70 is positioned at a cathode-electrode distance e away from the cathode assembly 14. In a similar manner to distance d, the cathode-electrode distance e is also a factor in determining focal spot 76 characteristics such as length and width, and accordingly, the imaging capabilities of the generated X-ray beam 20. The electrons are accelerated over the distance e towards the anode 16 and drift without acceleration over the distance d-e. The relation of the stream of electrons 18 to the distances d and e are discussed in further detail below.

Figure 3:
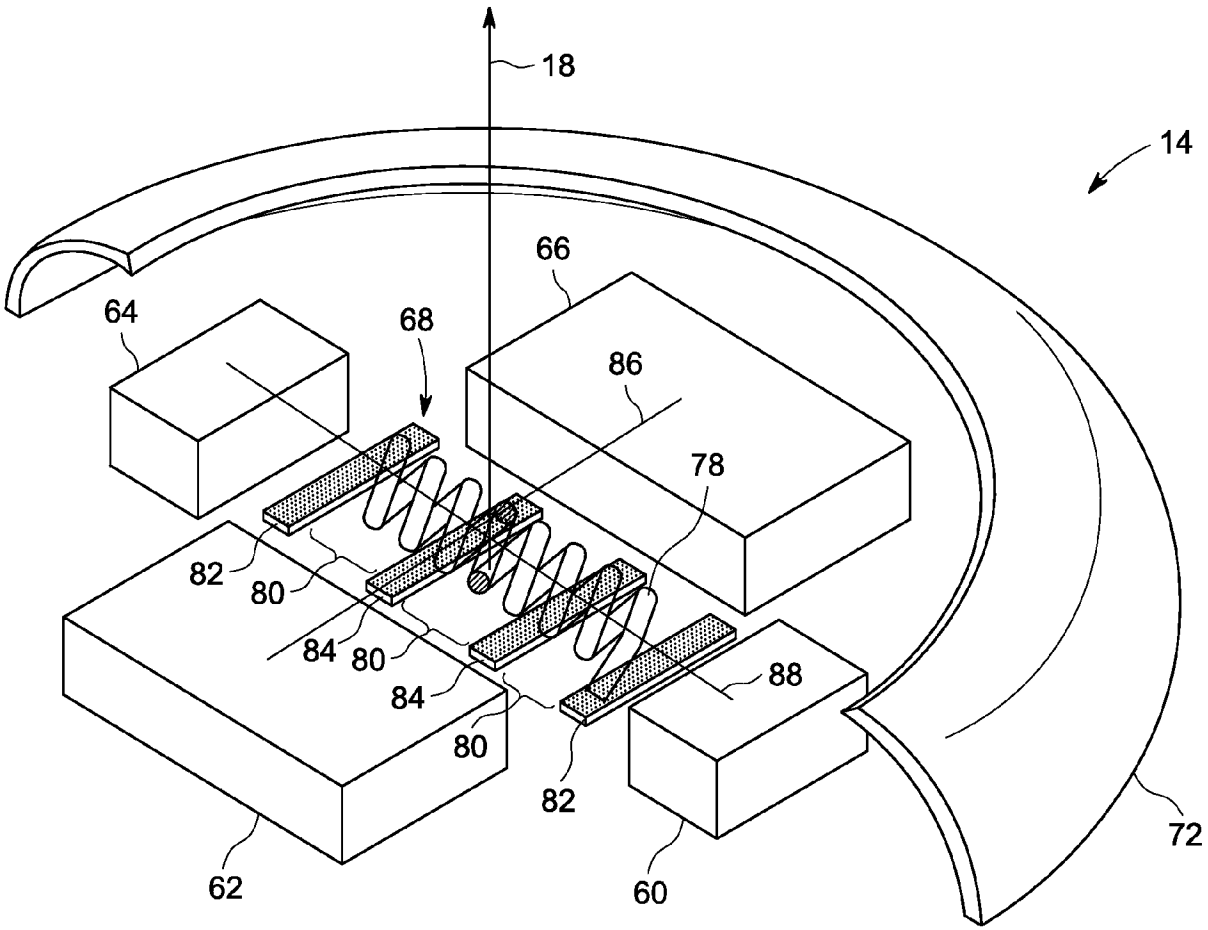
FIG. 3 is an exploded perspective view of an embodiment of an X-ray cathode having a segmented thermionic emitter, in accordance with one aspect of the present disclosure.

Turning to FIG. 3, the figure illustrates an embodiment of the X-ray cathode assembly 14 where the filament 78 is a coiled thermionic filament. As noted above, in the illustrated embodiment, segmentation electrodes 82 and 84 segment the filament 78 to form the segmented thermionic emitter 68. While the embodiment illustrated in FIG. 3 utilizes a coiled filament 78, other configurations may be used, including a flat thermionic filament. Further, the segmented thermionic emitter 68 may be in the form of a series of small, coiled filaments interleaved with segmentation electrodes, such as electrodes 82, 84. In other embodiments, the segmentation electrodes 82, 84 may be placed over the surface of a flat filament, which may form the segmentation electrode 68. Indeed, in a further embodiment, the segmented thermionic emitter 68 may include a series of small, flat filaments interleaved with segmentation electrodes. Such configurations are described in more detail below with respect to FIGS. 5-7.

According to present embodiments, the segmentation electrodes 80, 82 may be configured to cooperatively modulate some or all the filament 78. That is, in some embodiments, each pair of electrodes may modulate approximately one or more filament segments 80. In one embodiment, the modulation of each segment 80 may be performed using voltage levels such that each segment 80 may emit a stream of electrons having an emitted electron current density (i.e., a measure related to the number and density of electrons emitted per surface area of the filament) at reduced levels compared to conventional emitter configurations (e.g., non-segmented emitters). Additionally, the segmented thermionic emitter 68 (e.g., the segmentation electrodes 80, 82) may be more resistant to thermal degradation and back-bombardment of ions than other features configured for a biasing voltage reduction, such as a mesh. In one embodiment, this may be due to the larger size of the segmentation electrodes compared to the relatively small cross-sectional areas of a mesh, which may include tens, hundreds, or thousands of biasing areas. Further, the segmentation of the thermionic emitter 68 in substantially only one direction (e.g., the length direction or the width direction) may also provide a robust platform (i.e., increased resistance to degradation compared to a mesh structure) for effecting electron beam emission by the thermionic emitter 68.

FIG. 3 also illustrates the segmented thermionic emitter 68 as surrounded by four bias electrodes. The bias electrodes may include the length inside (L-ib) bias electrode 60, the width left (W-l) bias electrode 62, the length outside (L-ob) bias electrode 64, and the width right (W-r) bias electrode 66. In some embodiments, the bias electrodes may be used as a focusing lens for the stream of electrons 18 (and/or its component beams). A shield 72 may be positioned to surround the bias electrodes 60, 62, 64, 66 and placed at cathode potential. The shield 72 may aid in, for example, reducing peak electric fields due to sharp features of the electrode geometry and thus improve stability at relatively elevated tube voltages (e.g., voltages approaching 140 kV). In the illustrated embodiment, the shield 72 also surrounds the segmented thermionic emitter 68. Accordingly, the majority of the electrons may exit the cathode assembly 14 in a direction substantially normal to the planar area defined by the filament 78. Thus, in the illustrated embodiment, the resulting stream of electrons 18 is surrounded by the bias electrodes 60, 62, 64, and 66. The bias electrodes 60, 62, 64, and 66 may aid in focusing the stream of electrons 18 onto the focal spot 76 on the anode 16 though the use of active beam manipulation. In some embodiments, the bias electrodes 60, 62, 64, and 66 may each create a dipole field so as to electrically deflect the stream of electrons 18. The deflection of the stream of electrons 18 may then be used to aid in the focal spot targeting of the stream of electrons 18. Width bias electrodes 62, 66 may be used to help define the width of the resulting focal spot 76, while length bias electrodes 60, 64 may be used to help define the length of the resulting focal spot 76. Furthermore, in embodiments where each segment 80 emits an electron beam, the bias electrodes 60, 62, 64, and 66 may also adjust, target, and/or deflect each electron beam to focus the resulting electron beam into a focal spot of desired size.

In regards to the position of the segmentation electrodes 82, 84 in relation to the bias electrodes 60, 62, 64, and 66, the segmentation electrodes 82, 84 are disposed substantially parallel to a line 86 connecting the approximate middle of width electrodes 62 and 66, and substantially orthogonal to a line 88 connecting the approximate middle of the length electrodes 60 and 64. Such a configuration may allow segmentation of the filament 78 while retaining the electron beam acceleration/steering function of the bias electrodes 60, 62, 64, and 66. Accordingly, in some embodiments, a conventional X-ray tube may be retrofitted with a segmented thermionic emitter, such as the segmented thermionic emitter 68. For example, in situations where it is desirable to switch the X-ray tube 58 on a timeframe of less than approximately 1 millisecond (ms), a user may reconfigure an existing X-ray tube to contain the segmented thermionic emitter 68. Such retrofitting may involve the use of an X-ray tube cathode conversion kit having the segmented thermionic emitter 68. As one example, the user may remove the conventional thermionic emitter from an X-ray tube and replace it with the segmented thermionic emitter 68. Therefore, a retrofitted X-ray tube having a segmented thermionic emitter according to the present disclosure may contain or exclude one or more features described herein, such as the biasing electrodes 60, 62, 64, and 66.

Figure 4:
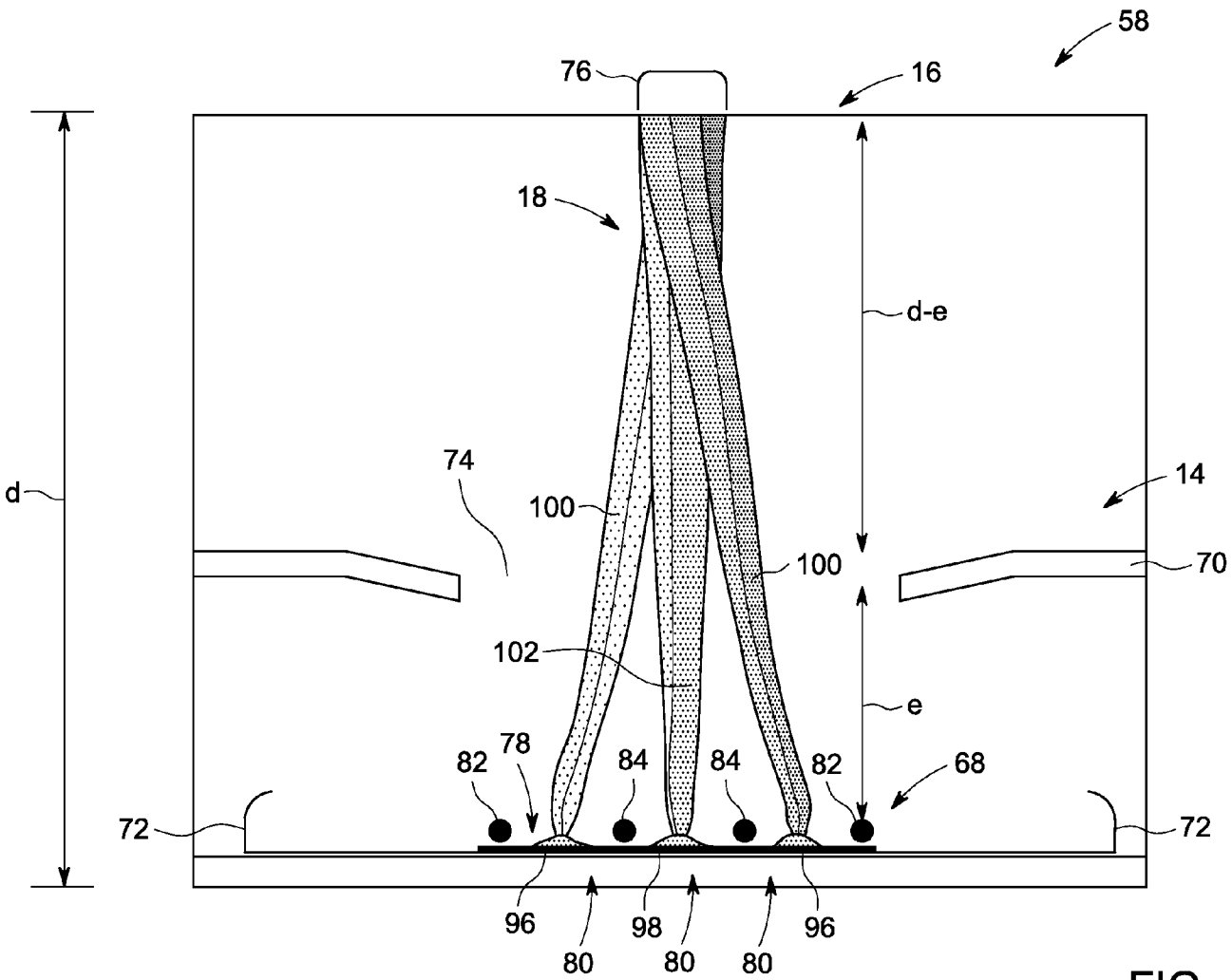
FIG. 4 is a cross-sectional view of an embodiment of a portion of the X-ray tube of FIG. 2 containing the cathode assembly of FIGS. 2 and 3.

FIG. 4 is a cross-sectional view of an embodiment of a portion of the X-ray tube 58 during operation. More specifically, FIG. 4 illustrates diagrammatically an embodiment of the nature of electron emission from each segment 80 of the segmented thermionic emitter 68. As noted above, the stream of electrons 18 emanating from the cathode assembly 14 may contain a number of composite electron beams emitted by one or more of the segments 80. In the illustrated embodiment, the segmented thermionic emitter 68 contains three segments 80. The segments 80 include a pair of outer segments 96 disposed between one end electrode 82 and one intermediate electrode 84. The segments 80 also include one inner segment 98 disposed between both intermediate electrodes 84. The outer segments 96 may produce outer electron beams 100, while the inner segment 98 produces an inner electron beam 102. Together, electron beams 100 and 102 form the composite electron beams of the stream of electrons 18, which is directed to the anode 16 at the focal spot 76. It should be noted that the electron beams may exhibit a cross-over point close to the surface of the segmented thermionic emitter 68 and, by way of the segmentation electrodes 82 and 84, are subsequently focused into the desired electron beam shape. Further, the segmentation electrodes 82, 84 may be biased with a common voltage or with individual voltages. In one embodiment, biasing each combination individually may allow fine control of the size of the focal spot 76 (by virtue of the cone or fan size of the electron beams 100, 102) as well as the location of the focal spot 76 as the flux (i.e., current) of the stream of electrons 18 is modulated. Again, according to the present disclosure, the current may be modulated at mA levels using biasing voltages at the segmentation electrodes 82, 84 of approximately 2 kV and below.

As can be appreciated from the illustration of FIG. 4, the electron beams 102 may not necessarily run parallel or substantially parallel to the line demarcating distance d. Further, the electron beams 100, 102 may be fan or cone-shaped. Accordingly, in one implementation, bias electrodes 60, 62, 64, and 66 depicted in FIGS. 2 and 3 may serve to adjust, accelerate and/or steer the electron beams 100, 102 towards the focal point 76. For example, one or more of the bias electrodes 60, 62, 64, and 66 may at least partially accelerate (e.g., steer) the electron beams 100, 102 through distance e towards the anode 16. Additionally or alternatively, one or more of the bias electrodes 60, 62, 64, and 66 (FIG. 3) may accelerate the electron beams 100, 102 towards an approximate center of the cathode assembly 14, which may be approximated by the middle electron beam 100. In further embodiments, the bias electrodes 60, 62, 64, and 66 may control the size and shape of each electron beam 100, 102 while in the acceleration/steering area represented by distance e. In such embodiments, the filament 78 in combination with one or more of the bias electrode 60, 62, 64, and/or 66, may be used to define one or more focal spots 76. Further, one or more of the bias electrodes 60, 62, 64, 66 may actively deflect the electron beams 100, 102 into one or more focal spots 76. For example, one or more of the bias electrodes 60, 62, 64, 66 may define a first broad focal spot 76 by minimizing a dipole field in the region defined by distance e. A second, narrower focal spot 76 may be defined by strengthening the dipole field. Indeed, any number and types of focal spots may be defined by active manipulation of the dipole field. As an example, distance e may be between approximately 20 and 30 millimeters. In the illustrated embodiment, the electron beams 100, 102 coalesce or converge in a drift area represented by distance d-e to form the stream of electrons 18. It should be noted that there may be other features of the X-ray tube 12 that are configured to perform steering, acceleration, and/or active manipulation of the dipole field in addition to or in lieu of the biasing electrodes 60, 62, 64, and 66. For example, the stream of electrons 18 may be steered by an external magnetic field in the area defined by the distance d-e and/or by the segmentation electrodes 82, 84 in an area proximate the surface of the filament 78.

Figure 5:
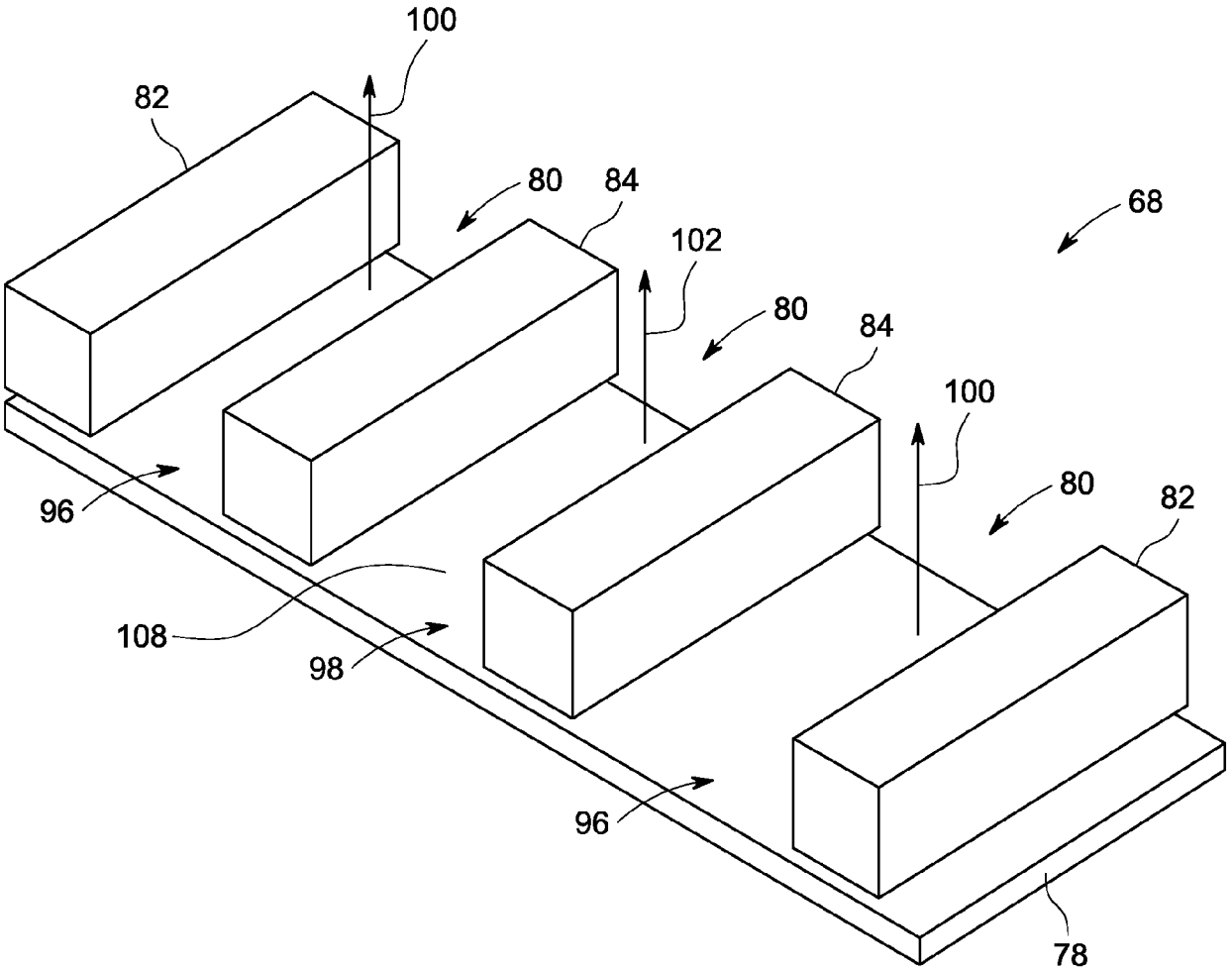
FIG. 5 is a perspective view of an embodiment of a substantially flat filament with segmentation electrodes disposed on a top surface, in accordance with one aspect of the present disclosure.

Turning now to FIG. 5, a perspective view of the segmented thermionic emitter 68 of FIG. 4 is illustrated. In the illustrated embodiment, the segmented thermionic emitter 68 includes the filament 78 on which the segmentation electrodes 82, 84 are disposed. More specifically, the segmentation electrodes 82, 84 are located on top of a surface 108 of the filament 78. Accordingly, each segment 96, 98 in between each pair of segmentation electrodes 82, 84 emit their respective electron beam 100, 102. For example, during operation of the X-ray tube 58, the outer segments 96 each emit the stream of electrons 100. Similarly, the inner segment 98 emits the electron beam 102. In embodiments according to the present disclosure, each segment 80 of the segmented thermionic emitter 68 may be modulated using voltages of less than approximately 2 kV. For example, the voltage may be between approximately 0 kV for full emission, −0.5 kV for reduced emission, and −2 kV for substantially complete mA-cutoff. The segments 80 may be modulated individually (i.e., each with a substantially unique voltage) or with a common voltage.

Figure 6:
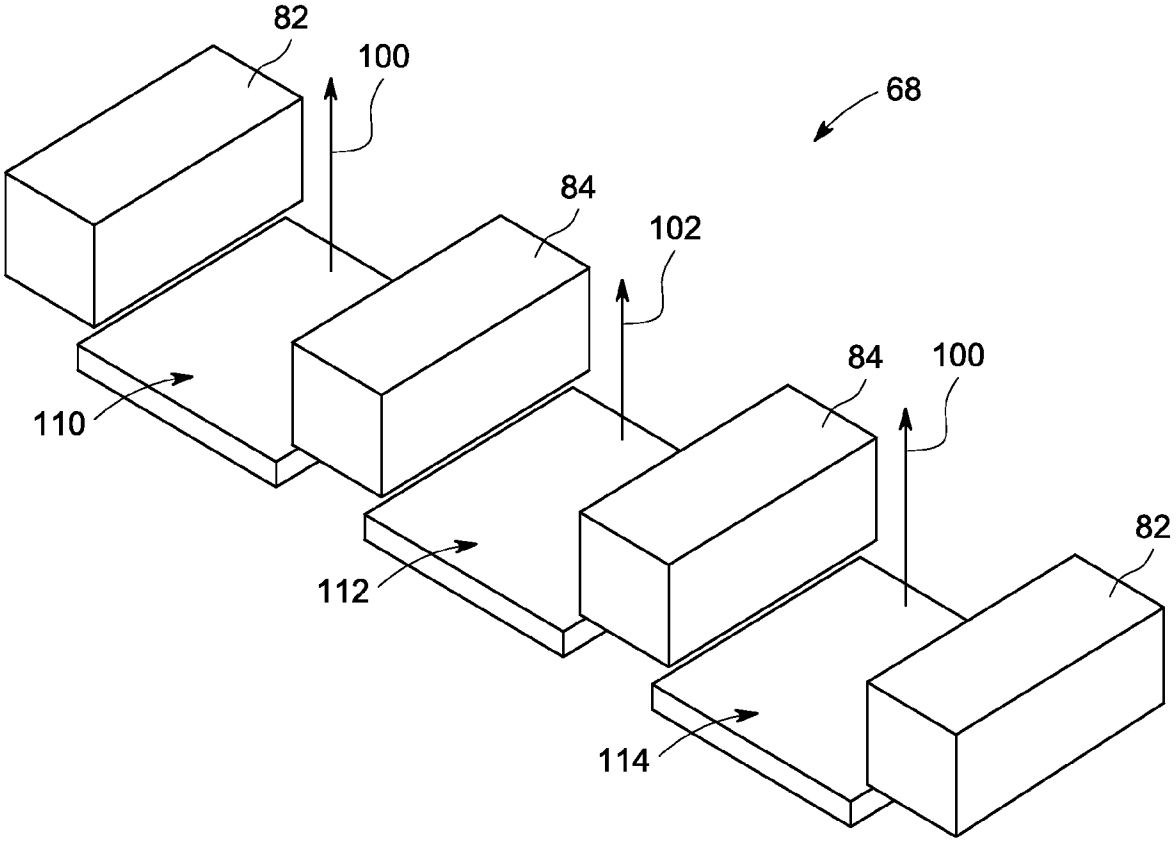
FIG. 6 is a perspective view of an embodiment of a series of substantially flat filaments interleaved with segmentation electrodes to form the segmented thermionic emitter, in accordance with one aspect of the present disclosure.

In other embodiments, more than one filament 78 may be used to define one or multiple focal spots 76. One such embodiment is depicted in FIG. 6, which is a perspective view of a series of substantially flat filaments 110, 112, and 114 interleaved with segmentation electrodes 82, 84 to form the segmented thermionic emitter 68. As depicted, the filaments 110, 112, and 114 emit electron beams 100 and 102. Therefore, a measure of redundancy can be provided should one of the filaments fail.

Each of the filaments 110, 112, and 114 may define a focal spot 76 based, at least in part, on characteristics of the filament 78, including size, shape, thermionic temperature, and so forth. As such, several filaments 110, 112, and 114 may be used to define different types of focal spots 76, for example focal spots 76 having different surface areas. Additionally, the embodiments utilizing multiple filaments 110, 112, and 114 may combine the use of one or more of the bias electrodes 60, 62, 64, 66 to aid in the definition and creation of the multiple focal spots 76 as described above.

Figure 7:
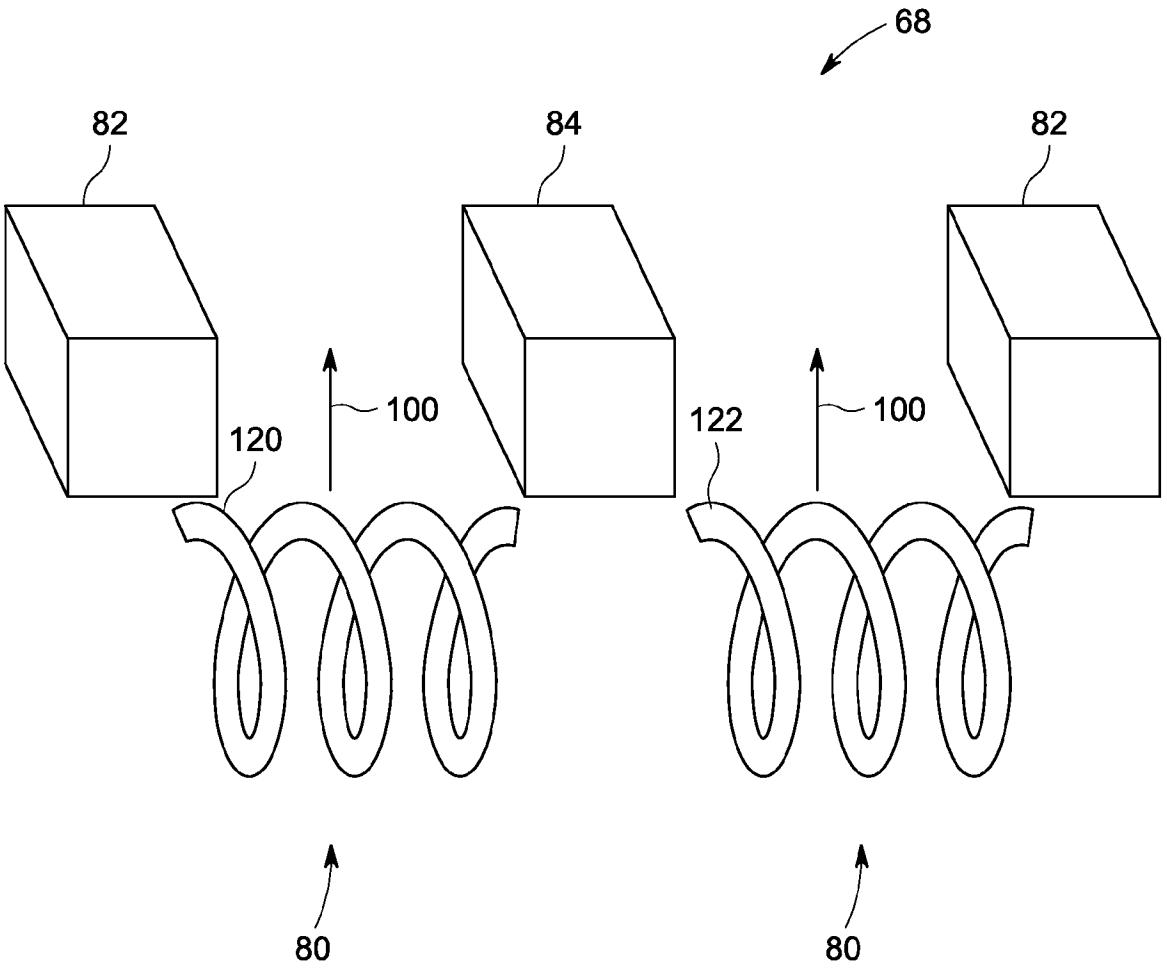
FIG. 7 is a perspective view of an embodiment of a series of coiled filaments interleaved with segmentation electrodes to form the segmented thermionic emitter, in accordance with one aspect of the present disclosure.

FIG. 7 is a perspective view of an embodiment of a pair of coiled filaments 120 and 122 interleaved with the segmentation electrodes 82, 84 to form the segmented thermionic emitter 68. In a similar manner to the embodiment depicted in FIG. 6, rather than being disposed on a surface of the filament (s), the segmentation electrodes 82, 84 directly separate one coiled segment 120 from another coiled segment 122. As noted above, mA modulation of the segmented thermionic emitter 68 may be achieved at voltages less than approximately 2 kV. Further, while FIGS. 5-7 depict segmented thermionic emitters 68 with two or three segments 80, other configurations are also contemplated, such as four, five, six, seven or more segments 80, and/or fractions of segments 80 (i.e., segments of differing size and shape). Therefore, the number of segmentation electrodes 82, 84 may vary as well. For example, the end segmentation electrodes 82 may be excluded (i.e., zero end segmentation electrodes), or there may be two or more. Likewise, the number of intermediate segmentation electrodes 84 may vary, such as between approximately 0 and 10. In some embodiments, the number of segmentation electrodes may be between approximately 0 and 6, 2 and 4, or 3. Indeed, the number of segments 80, electrodes 82, 84, and the biasing voltage and/or modulating current may depend on the size of the filament 78, the size of the X-ray tube 58, and the application in which the X-ray tube 58 is to be employed, among others.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An imaging system, comprising:

an X-ray tube configured to generate an X-ray beam at one or more energies, the X-ray tube comprising:

a cathode assembly comprising:

a segmented thermionic emitter comprising a plurality of segments substantially spanning a length of the segmented thermionic emitter, wherein the segmented thermionic emitter is configured to emit one or more electron beams in a direction towards an anode to generate the X-ray beam; and a plurality of segmentation electrodes comprising pairs of segmentation electrodes that define the plurality of segments of the segmented thermionic emitter, wherein the plurality of segmentation electrodes are disposed on a continuous surface of a filament to thereby produce the plurality of segments of the segmented thermionic emitter, and each pair is configured to electrostatically modulate one segment of the plurality of segments individually;

an X-ray detector configured to detect X-rays generated by the X-ray tube and generate a signal based on the detected X-rays; and data acquisition circuitry configured to convert the signal generated by the detector into one or more images of a subject of interest.

2. The imaging system of claim 1, wherein the plurality of segments are configured to allow modulation of the segmented thermionic emitter using between about 0 mA and 2000 mA.

3. The imaging system of claim 2, wherein the plurality of segments are configured to allow switching of the segmented thermionic emitter using between approximately 0 V and −2 kV with respect to the filament potential.

4. The imaging system of claim 1, wherein the continuous surface is a substantially flat surface.

5. The imaging system of claim 1, wherein the continuous surface is a substantially coiled surface.

6. The imaging system of claim 1, wherein the plurality of segmentation electrodes comprise a pair of end electrodes and one to four intermediate electrodes.

7. The imaging system of claim 1, wherein each segment of the plurality of segments emits a corresponding electron beam when activated by one of the pairs of segmentation electrodes, and the electron beams all substantially converge at a focal spot on the anode.

8. The imaging system of claim 1, wherein the plurality of segmentation electrodes switch the segmented thermionic emitter within approximately 1-900 microseconds.

9. The imaging system of claim 1, comprising X-ray control circuitry configured to execute code for switching the X-ray tube in less than approximately 1 millisecond.

10. A segmented thermionic emitter comprising:

a plurality of emitter segments substantially spanning a length of the segmented thermionic emitter and aligned substantially parallel with one another; and a plurality of segmentation electrodes that define the plurality of segments, wherein the plurality of segmentation electrodes are disposed on a continuous surface of a filament to thereby produce the plurality of segments of the segmented thermionic emitter are configured to electrostatically modulate a beam current from each emitter segment of the plurality of emitter segments individually.

11. The segmented thermionic emitter of claim 10, wherein the plurality of segmentation electrodes are configured to electrostatically modulate the segmented thermionic emitter using a voltage of less than approximately 2 kV.

12. The segmented thermionic emitter of claim 10, wherein the segmented thermionic emitter is configured to replace a non-segmented thermionic emitter of an X-ray tube cathode.

13. The segmented thermionic emitter of claim 10, wherein the plurality of segmentation electrodes are disposed on the continuous surface as pairs to form each segment.

14. An X-ray tube, comprising:

a cathode assembly comprising:

a segmented thermionic emitter having a plurality of segments and a plurality of electrodes that define the plurality of segments, wherein the plurality of electrodes are disposed on a continuous surface of a filament to thereby produce the plurality of segments of the segmented thermionic emitter and are configured to electrostatically modulate electron beam emission from each segment individually; and an anode, wherein the cathode assembly and the anode are capable of being placed at an electrical potential to create a voltage to extract electrons from a surface of the segmented thermionic emitter, and each segment of the segmented thermionic emitter is configured to emit an electron beam, and the electron beams form a composite electron beam.

15. The X-ray tube of claim 14, wherein the plurality of electrodes are configured to electrostatically modulate each segment individually by placing a biasing voltage across each segment.

16. The X-ray tube of claim 15, wherein when the biasing voltage is less than approximately −2 kV, the electron mission from the plurality of segments is substantially stopped.

17. The X-ray tube of claim 14, comprising a plurality of biasing electrodes configured to accelerate and steer the electron beam emissions from the plurality of segments, wherein the plurality of biasing electrodes comprise a pair of width electrodes and a pair of length electrodes, and the plurality of segmentation electrodes are disposed substantially parallel to a line connecting the approximate middle of the width electrodes and substantially orthogonal to a lone connecting the approximate middle of the length electrodes.

18. The X-ray tube of claim 14, wherein the plurality of segmentation electrodes comprises a plurality of pairs of segmentation electrodes, and each pair of segmentation electrodes is individually biased.

* * * * *